US010460685B2

(12) United States Patent
He et al.

(10) Patent No.: US 10,460,685 B2
(45) Date of Patent: Oct. 29, 2019

(54) METHOD CIRCUIT AND LIQUID CRYSTAL PANEL FOR COMPENSATING GRAY SCALE VOLTAGE

(71) Applicant: Shenzhen China Star Optoelectronics Technology Co., Ltd., Shenzhen, Guangdong (CN)

(72) Inventors: Tao He, Guangdong (CN); Yu-Yeh Chen, Guangdong (CN); Yu Wu, Guangdong (CN); Jhen-wei He, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 76 days.

(21) Appl. No.: 15/739,709

(22) PCT Filed: Aug. 17, 2017

(86) PCT No.: PCT/CN2017/097744
§ 371 (c)(1),
(2) Date: Dec. 23, 2017

(87) PCT Pub. No.: WO2018/184335
PCT Pub. Date: Oct. 11, 2018

(65) Prior Publication Data

US 2018/0336855 A1 Nov. 22, 2018

(30) Foreign Application Priority Data

Apr. 7, 2017 (CN) ..... 2017 1 0224430

(51) Int. Cl.
*G09G 3/36* (2006.01)
*G09G 3/20* (2006.01)

(52) U.S. Cl.
CPC ..... *G09G 3/3655* (2013.01); *G09G 3/2007* (2013.01); *G09G 3/3696* (2013.01); (Continued)

(58) Field of Classification Search
CPC ... G09G 3/3655; G09G 3/3696; G09G 3/2007
(Continued)

(56) References Cited

U.S. PATENT DOCUMENTS

2007/0290970 A1* 12/2007 Liu ..... G09G 3/3648 345/89
2010/0066656 A1 3/2010 Yang
(Continued)

FOREIGN PATENT DOCUMENTS

CN 101739978 A 6/2010
CN 102201206 A 9/2011
(Continued)

*Primary Examiner* — Adam J Snyder
(74) *Attorney, Agent, or Firm* — Andrew C. Cheng

(57) ABSTRACT

Disclosed are a gray scale voltage compensation method of a liquid crystal panel, a circuit for a liquid crystal panel and a liquid crystal panel including the circuit. The invention adjusts the common voltage and/or compensates the pixel voltage to minimize the afterimage of the whole liquid crystal panel under the premise of saving the cost of the liquid crystal panel and greatly improves the panel display performance.

14 Claims, 6 Drawing Sheets

(52) U.S. Cl.
CPC ..... *G09G 2300/0823* (2013.01); *G09G 2320/0223* (2013.01); *G09G 2320/0257* (2013.01); *G09G 2320/0686* (2013.01)

(58) Field of Classification Search
USPC ..... 345/96
See application file for complete search history.

(56) References Cited

U.S. PATENT DOCUMENTS

| | | | | |
|---|---|---|---|---|
| 2011/0221760 | A1* | 9/2011 | Irie | G09G 3/3648 345/589 |
| 2011/0234625 | A1* | 9/2011 | Irie | G09G 3/3648 345/601 |
| 2012/0229523 | A1* | 9/2012 | Maruyama | G09G 3/3648 345/690 |
| 2013/0278584 | A1* | 10/2013 | Liao | G06F 3/038 345/212 |
| 2014/0071034 | A1* | 3/2014 | Wang | G09G 3/3655 345/99 |
| 2015/0213769 | A1* | 7/2015 | Shin | G09G 3/3607 345/690 |
| 2016/0314755 | A1 | 10/2016 | Feng et al. | |
| 2016/0343317 | A1* | 11/2016 | Syu | G09G 3/36 |

FOREIGN PATENT DOCUMENTS

| | | | |
|---|---|---|---|
| CN | 104376823 | A | 2/2015 |
| CN | 105632450 | A | 6/2016 |
| CN | 106098013 | A | 11/2016 |

* cited by examiner

METHOD CIRCUIT AND LIQUID CRYSTAL PANEL FOR COMPENSATING GRAY SCALE VOLTAGE

FIELD OF THE INVENTION

The present invention relates to a liquid crystal display field, and more particularly to a gray scale voltage compensation method of a liquid crystal panel, a circuit for a liquid crystal panel and a liquid crystal panel.

BACKGROUND OF THE INVENTION

The Gate scan voltage is influenced by RC (Resistance-Capacitance) circuits loading in the panel to lead to that the voltage drops of the scan lines are different in the different display areas of the liquid crystal panel. Due to the existence of the feed through effect, the different voltage drops cause the pixel voltage of the different display areas to be asymmetrical about the common voltage, i.e. the different levels of IS (image sticking).

Today's liquid crystal panels are designed to generally use one common voltage for cost savings. By adjusting the common voltage to offset the phenomenon of pixel voltage asymmetry about the common voltage caused by the feed through effect, the afterimage can be initially improved. However, the feed through effects of the different display areas of the liquid crystal panel are different. The inventors of the present application have found that for a liquid crystal panel using a common voltage, the adjustment of the common voltage can only keep the afterimage of a portion of display areas of the whole liquid crystal panel to be minimal.

SUMMARY OF THE INVENTION

The embodiment of the present invention provides a gray scale voltage compensation method of a liquid crystal panel, a circuit for a liquid crystal panel and a liquid crystal panel to solve the problem that the after image in the whole liquid crystal panel area can not be adjusted to minimum by adjusting the common voltage.

For solving the aforesaid technical issue, the embodiment of the present invention first provides a gray scale voltage compensation method of a liquid crystal panel and the method comprises:

determining a common voltage and pixel voltages, wherein the pixel voltage is an alternating inversion voltage of positive and negative polarities such that the pixel voltages of the positive and negative polarities of all pixels of at least two different display areas in the liquid crystal panel are symmetrical with respect to the common voltage and maximum pixel voltages of the positive polarity of all the pixels of the at least two different display areas are equal, wherein the common voltage is adjusted and/or at least one portion of the pixel voltages of the at least two different display areas in the liquid crystal panel are compensated;

outputting the common voltage and the pixel voltages.

For solving the aforesaid technical issue, the embodiment of the present invention second provides a circuit for a liquid crystal panel, wherein the liquid crystal panel comprises: a plurality of gate lines parallel to one another, a plurality of data lines parallel to one another and intersected with the gate lines in a perpendicular and insulated manner, a plurality of thin film transistors located at intersections of the gate lines and the data lines, a plurality of pixel electrodes and a common electrode, the pixel electrodes are coupled to the data lines via the thin film transistors and arranged opposite to the common electrode;

the circuit for the liquid crystal panel comprises a driving circuit and a control circuit;

the driving circuit drives the liquid crystal panel;

the control circuit adjusts a common voltage and/or compensates at least one portion of pixel voltages of at least two different display areas in the liquid crystal panel via the driving circuit to ultimately determine the common voltage and the pixel voltages, the pixel voltage is an alternating inversion voltage of positive and negative polarities such that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal;

the driving circuit also outputs the common voltage and the pixel voltages which are ultimately determined.

For solving the aforesaid technical issue, the embodiment of the present invention third provides a liquid crystal panel, comprising a circuit for the liquid crystal panel, wherein the liquid crystal panel comprises: a plurality of gate lines parallel to one another, a plurality of data lines parallel to one another and intersected with the gate lines in a perpendicular and insulated manner, a plurality of thin film transistors located at intersections of the gate lines and the data lines, a plurality of pixel electrodes and a common electrode, the pixel electrodes are coupled to the data lines via the thin film transistors and arranged opposite to the common electrode;

the circuit for the liquid crystal panel comprises a driving circuit and a control circuit;

the driving circuit drives the liquid crystal panel;

the control circuit adjusts a common voltage and/or compensates at least one portion of pixel voltages of at least two different display areas in the liquid crystal panel via the driving circuit to ultimately determine the common voltage and the pixel voltages, the pixel voltage is an alternating inversion voltage of positive and negative polarities such that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal;

the driving circuit also outputs the common voltage and the pixel voltages which are ultimately determined.

The technical solution provided by the invention has the beneficial effect compared with the prior art are: being different from prior art, in which only the common voltage of the whole liquid crystal panel is adjusted or the common voltages of the respective display areas which are independent from one another are respectively adjusted and the pixel voltages of the respective display areas are respectively adjusted, in the gray scale voltage compensation method of the liquid crystal panel provided by this embodiment, the liquid crystal panel with one common voltage is utilized for saving the cost. By adjusting the common voltage and/or compensating the at least one portion of the pixel voltages of the at least two different display areas in the liquid crystal panel, the common voltage and the pixel voltages are determined so that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal. Then, the common voltage and the pixel voltages are outputted. Ultimately, the afterimage of the whole liquid crystal panel is decreased to a minimum. Comparing with prior art, the panel display performance of the present invention is greatly improved while the cost of the liquid crystal panel is saved.

DETAILED DESCRIPTION OF PREFERRED EMBODIMENTS

Figure 1:
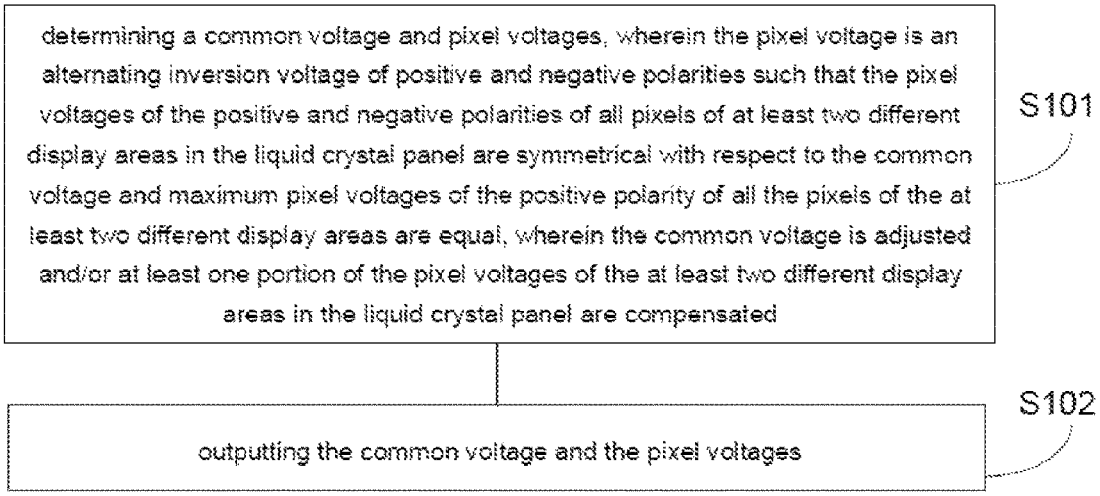
FIG. 1 is a flowchart diagram of a gray scale compensation method of a liquid crystal panel provided by the first embodiment of the present invention.

Please refer to FIG. 1. FIG. 1 shows a flowchart of a gray scale compensation method of a liquid crystal panel provided by the first embodiment of the present invention. For convenience, FIG. 1 merely shows the related part with the embodiment of the present invention. The gray scale compensation method of the liquid crystal panel illustrated in FIG. 1 comprises Step S101 and Step S102:

Step S101, determining a common voltage and pixel voltages, wherein the pixel voltage is an alternating inversion voltage of positive and negative polarities such that the pixel voltages of the positive and negative polarities of all pixels of at least two different display areas in the liquid crystal panel are symmetrical with respect to the common voltage and maximum pixel voltages of the positive polarity of all the pixels of the at least two different display areas are equal, wherein the common voltage is adjusted and/or at least one portion of the pixel voltages of the at least two different display areas in the liquid crystal panel are compensated.

Specifically, as the liquid crystal panel just starts work, there is an original common voltage and each pixel of the liquid crystal panel also has an original pixel voltage. The pixel voltage is an alternating inversion voltage of positive and negative polarities. The common voltage and the pixel voltage determine the liquid crystal panel output gray scale, together.

Figure 2:
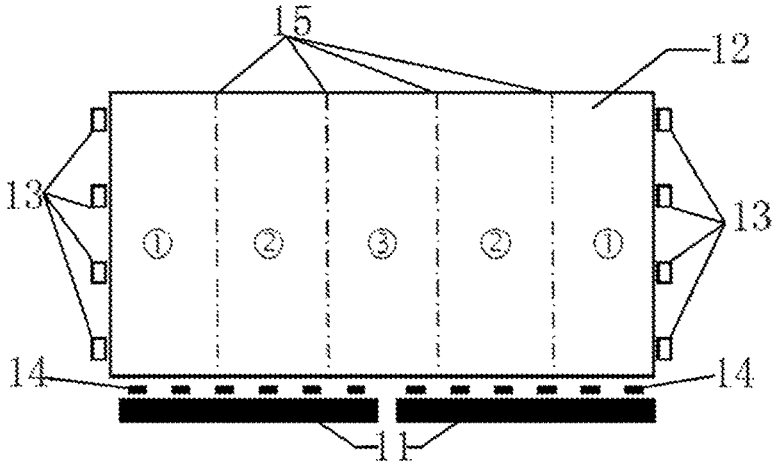
FIG. 2 is a structure diagram of a liquid crystal panel in a gray scale compensation method of a liquid crystal panel provided by the first embodiment of the present invention.

Please refer to FIG. 2. FIG. 2 shows a structure of a liquid crystal panel in a gray scale compensation method of a liquid crystal panel provided by the first embodiment of the present invention. The two lowest black rectangles 11 in FIG. 2 represent the data drive circuits. The gray area 12 represents the substrate of the liquid crystal panel. The small black rectangles 14 between the data driving end and the substrate represent electrodes of charging the panel. The rectangular frames 13 with black borders on both sides of the substrate are the gate driving circuits. The scan lines are horizontally distributed along the substrate and connected to the gate driving circuits 13. The data lines are vertically distributed. The marks ①, ② and ③ in FIG. 2 represent five display areas, which the liquid crystal panel are divided according to the display information (such as luminance) of the liquid crystal panel and the requirement of compensating the gray scale voltage after power-on. The black dot lines 15 indicate the boundaries of adjacent display areas. Specifically, such division is not a physical division of the liquid crystal panel but only the illustrative and artificial division for the need of description for display.

Figure 3:
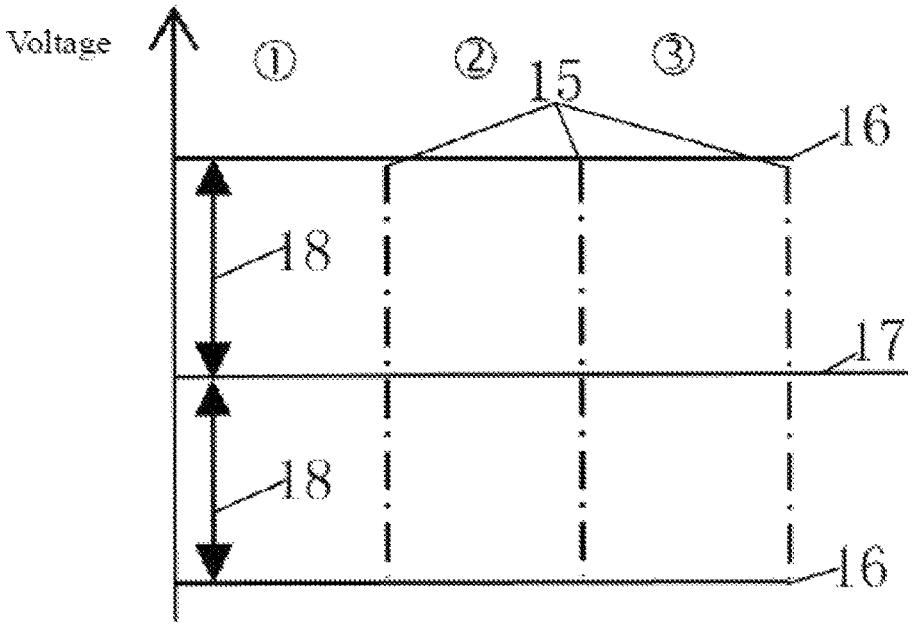
FIG. 3 is an ideal diagram of a gray scale voltage outputted by a liquid crystal display panel in a gray scale compensation method of a liquid crystal panel provided by the first embodiment of the present invention.

Please refer to FIG. 3. FIG. 3 shows an ideal gray scale voltage outputted by a liquid crystal display panel in a gray scale compensation method of a liquid crystal panel provided by the first embodiment of the present invention. The vertical axis in FIG. 3 represents the magnitude of the voltage value. The two horizontal black solid lines 16 represent the output gray scale voltage (such as 127 gray). The horizontal gray solid line 17 represents the original common voltage VCOM. The vertical black solid lines with double arrows 18 represent the original pixel voltages $\Delta v$ of the liquid crystal panel. Because the pixel voltage is an inversion voltage of positive and negative polarities, the direction of the voltage value increase above the original common voltage means the original pixel voltage $+\Delta v$ of the positive polarity and the direction of the voltage value decrease under the original common voltage means the original pixel voltage $-\Delta v$ of the negative polarity. In FIG. 3, ①, ② and ③ indicate the three display areas of the liquid crystal panel in FIG. 2 from left to right or from right to left. The black dot lines 15 indicate the boundaries of adjacent display areas. Ideally, the original pixel voltage is symmetrical about the original common voltage, i.e., the values of the original pixel voltages of positive and negative polarities inversion in all the display areas of the liquid crystal panel are $\Delta v$. The display information (e.g. the luminance) of the whole liquid crystal panel is the same under the functioning of the original common voltage and the original pixel voltage at the same time. Then, the display performance of the liquid crystal panel is the best.

Figure 4:
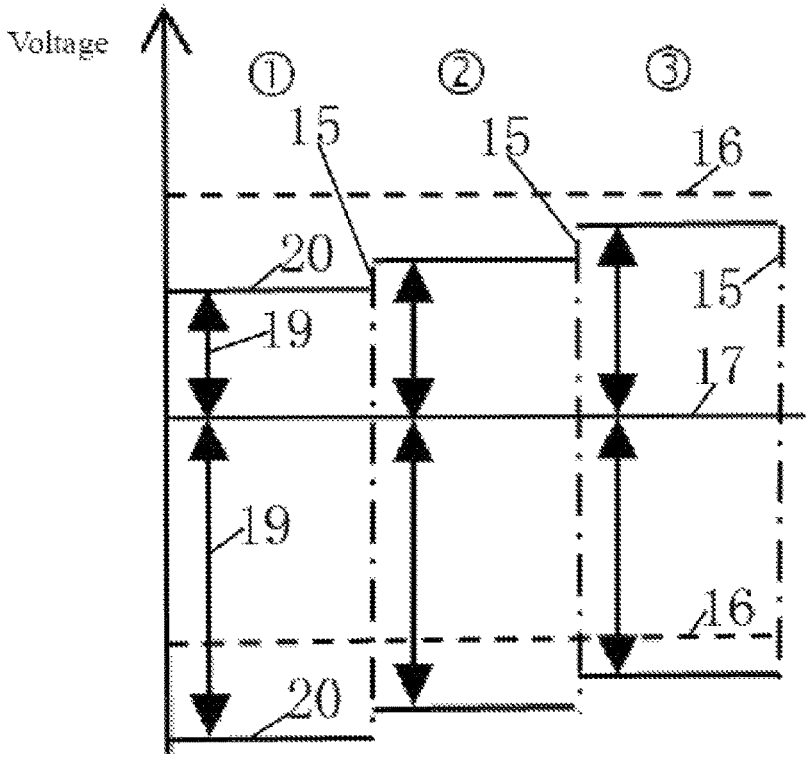
FIG. 4 is a actual diagram of a gray scale voltage outputted by a liquid crystal display panel in a gray scale compensation method of a liquid crystal panel without compensation provided by the first embodiment of the present invention.

Please refer to FIG. 4. FIG. 4 shows an actual gray scale voltage outputted by a liquid crystal display panel in a gray scale compensation method of a liquid crystal panel without compensation provided by the first embodiment of the present invention. The vertical black solid lines 19 with double arrows shown in the display areas ①, ②, ③ shown in FIG. 4 represent the existence of the RC (Resistance-Capacitance) circuits loading influence and the feed through effect. With the pixel voltage changed from the original pixel voltage, the horizontal black dotted lines 16 represent the gray scale voltage in ideal state (in the practical condition, it cannot reach the gray scale voltage in FIG. 3 but in order to compare the observation and to describe easily, it is in the form of a dotted line). The horizontal black solid lines 20 in the display areas ①, ② and ③ represent the gray scale voltages due to the influence of the original common voltage and the pixel voltage changed due to the feed through effect. The remaining symbols have the same meaning as in FIG. 3 and will not be described here. As shown in FIG. 4, the pixel voltage after change is asymmetric about the original common voltage. Therefore, the display information (e.g., the luminance) of the whole liquid crystal panel is different in the display areas ①, ②, ③ and all the output voltages cannot reach the ideal 127 gray. Besides, the pixel voltage dropping values (marked as Δft) in the display areas ①, ②, ③ are sequentially decreased. The reason is that the gate voltage has an RC delay at the different locations on the scan line. At the position closer to the gate driving circuit, the delay is small and the Δvgate large. At the position more remote from the gate driving circuit, the delay is large and the Δvgate is small. The pixel voltage dropping value Δft is:

$$\Delta ft = \frac{\Delta vgate * Cgd}{Cs + Clc + Cgd}$$

wherein Δvgate represents the voltage difference of the on voltage and the off voltage of the gate voltage, i.e. von−voff; Cgd represents the TFT parasitic capacitance; Cs represents the storage capacitance; Clc represents the liquid crystal capacitance. Specifically, the actual voltage pixel dropping values Δft in the display areas ①, ②, ③ cannot be derived with the aforesaid formula. Here, this only explains the principle. Moreover, the real change of the display information of the liquid crystal panel is not sudden but relatively continuously gradient. Here, the liquid crystal panel is artificially divided into the display areas only for the clarity.

Specifically, the determination of the common voltage in Step S101 is obtained by constantly adjusting the original common voltage. The determined value of the common voltage is an experience value after repeated attempts, which may be different for different liquid crystal panels.

Specifically, in S101, "symmetry" and "equality" are not symmetrical and equal in the strict sense of mathematics. The symmetry refers to that the different values of the pixel voltages of positive and negative polarities inversion in the same display area is in the first predetermined range. The equality refers to that the different value of the maximum pixel voltages of the positive polarity in two different display areas is within the second predetermined range. In fact, these two predetermined ranges are related to the perception of the display of information (e.g., the luminance) by the human eye on the liquid crystal panel. In theory, as the positive and negative polarities of the pixel voltages in the same display area invert, as long as the human eye can not feel the display area flicker phenomenon, it means that the pixel voltages have been symmetrical about the common voltage. As long as the human eye does not feel the difference in the display information (e.g., the luminance) of the two different display areas, it means that the maximum pixel voltages of the positive polarity of all the pixels in the two different display areas are equal. In fact, the maximum pixel voltages of negative polarity for all the pixels of the two different display areas are equal to each other under the aforementioned symmetry and equality. It is important to note that although different people have differences in the perception of display information (e.g., the luminance) of the liquid crystal panel, the display information (e.g., luminance) perceived by the normal human eye is within some exact range.

Specifically, the adjustment of the common voltage and/or the compensation of the pixel voltage to determine the common voltage and/or pixel voltage is a process of constant attempt and fine tune so that the human eye can not feel flicker in the same display area, the human eye can not feel that the maximum luminances of two different display areas are different and ultimately, at least two different display areas of the whole liquid crystal panel can evenly display.

Specifically, in Step S101, adjusting the common voltage and/or compensating at least one portion of the pixel voltages of the at least two different display areas in the liquid crystal panel are specified according to that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal. It does not mean that the common voltage must be adjusted or the pixel voltage must be compensated. For instance, the common voltage remains unchanged and the pixel voltages of the positive and negative polarities in the different display areas are compensated such that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal. For instance, the common voltage remains unchanged and the pixel voltages of the positive and negative polarities in the different display areas are compensated such that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal.

Optionally, in the embodiment of the present invention, adjusting the common voltage can be achieved by Step S1010, Step S1011, Step S1012, Step S1013 and Step S1014 in the following:

Step S1010, constantly adjusting a value of the common voltage and outputting the same and setting the pixel voltage as one of a positive polarity voltage and a negative polarity voltage corresponding to the value of the common voltage.

For example, the value of the common voltage is adjusted from the original 2 to 3 and then is outputted. Then, the pixel voltage is alternately inverted for the positive and negative polarities with respect to the adjusted common voltage 3.

Step S1011, collecting two images including the at least two different display areas of the liquid crystal panel, which are respectively marked as a first positive image and a first negative image after adjusting the value of the common voltage and outputting the same each time, wherein the first positive image corresponds to the pixel voltage of the positive polarity voltage and the first negative image corresponds to the pixel voltage of the negative polarity voltage.

For example, the value of the common voltage is adjusted from the original 2 to 3 and then is outputted. If the pixel voltage is positive, the image shown in the areas ② and ③ of FIG. 2 is collected and marked as the first positive image. If the pixel voltage is negative, the image shown in the areas ② and ③ of FIG. 2 is also collected and marked as the first negative image.

Step S1012, calculating a first similarity of a luminance value of the first positive image and a luminance value of the first negative image.

Specifically, the first similarity is the measure of the luminance similarity between the first positive image and the first negative image.

Optionally, calculating the first similarity of the luminance value of the first positive image and the luminance value of the first negative image specifically comprises calculating an expectation and a standard deviation of absolute values of differences of the luminance values of the pixels corresponding to the first positive image and the first negative image.

For example, a luminance value of the first pixel of the first positive image is 100, a luminance value of the second pixel of the first positive image is 98, . . . , a luminance value of the first negative image corresponding to the first pixel is 99, a luminance value corresponding to the second pixel is 101, . . . , then an absolute value of the luminance difference of the first pixel is 1, an absolute value of the luminance difference of the second pixel is 2, . . . , the expectation and the standard deviation of the absolute values of all the aforesaid pixels are calculated. The expectation can be an average value or a weighted average value.

Specifically, an indicator representing the similarity of two images can also be variance or standard deviation.

Step S1013, comparing a calculation result of the first similarity with a predetermined threshold range.

Specifically, the predetermined threshold range is an empirical range of values that is obtained by a large number of attempts.

For instance, the predetermined threshold range comprises the predetermined threshold range of the expectation and the predetermined threshold range of the standard deviation.

Step S1014, stopping adjusting the value of the common voltage until the calculation result of the first similarity conforms to the predetermined threshold range.

For instance, if the expectation and the standard deviations calculated in Step S1012 fall within the respective predetermined threshold values, it means that the liquid crystal panel area showing the current collected image has already met the standard of adjustment and adjusting the value of the common voltage is stopped.

Optionally, in the embodiment of the present invention, compensating at least one portion of the pixel voltages of the at least two different display areas in the liquid crystal panel can be achieved by Step S1015, Step S1016, Step S1017, Step S1018 and Step S1019:

Step S1015, constantly compensating a value of the pixel voltage and outputting the same, wherein the pixel voltage is the positive polarity voltage and the negative polarity voltage, each compensated once.

Optionally, the same compensation value can be provided to the adjacent positive and negative voltages.

Step S1016, collecting two images including the at least two different display areas of the liquid crystal panel, which are respectively marked as a second positive image and a second negative image after each compensating the value of the pixel voltage once and outputting the same, wherein the second positive image corresponds to the pixel voltage of the positive polarity voltage and the second negative image corresponds to the pixel voltage of the negative polarity voltage.

For example, after the original positive polarity pixel voltage value is compensated from the original 97 to 107 and then is outputted, the image shown in two different areas including the area ① of FIG. 2 is collected and marked as the first positive image. As the pixel voltage is converted to be negative polarity pixel voltage and after the value of the original negative polarity pixel voltage is compensated from the original −157 to −147 and then is outputted, the image shown in two different areas including the area ① of FIG. 2 is also collected and marked as the first negative image.

Step S1017, calculating a second similarity of a luminance value of the second positive image and a luminance value of the second negative image.

Optionally, calculating the second similarity of the luminance value of the second positive image and the luminance value of the second negative image comprises calculating an expectation and a standard deviation of absolute values of differences of the luminance values of the pixels corresponding to the second positive image and the second negative image.

For example, a luminance value of the first pixel of the second positive image is 100, a luminance value of the second pixel of the first positive image is 98, . . . , a luminance value of the second negative image corresponding to the first pixel is 99, a luminance value corresponding to the second pixel is 101, . . . , then an absolute value of the luminance difference of the first pixel is 1, an absolute value of the luminance difference of the second pixel is 2, . . . , the expectation and the standard deviation of the absolute values of all the aforesaid pixels are calculated. The expectation can be an average value or a weighted average value.

Specifically, an indicator representing the similarity of two images can also be variance or standard deviation.

Step S1018, comparing a calculation result of the second similarity with a predetermined threshold range.

Specifically, the predetermined threshold range is an empirical range of values that is obtained by a large number of attempts.

For instance, the predetermined threshold range comprises the predetermined threshold range of the expectation and the predetermined threshold range of the standard deviation.

Step S1019, stopping compensating the value of the pixel voltage until the calculation result of the first similarity conforms to the predetermined threshold range.

For instance, if the expectation and the standard deviations calculated in Step S1017 fall within the respective predetermined threshold values, it means that the liquid crystal panel area showing the current collected image has already met the standard of adjustment and the value of the pixel voltage is compensated.

Optionally, a step of adjusting the common voltage and a step of compensating the at least one portion of the pixel voltages of the at least two different display areas in the liquid crystal panel comprise: adjusting the common voltage first and then, compensating the at least one portion of the pixel voltages of the at least two different display areas in the liquid crystal panel.

Specifically, the descriptions of the aforesaid Step S1010, Step S1011, Step S1012, Step S1013, Step S1014, Step S1015, Step S1016, Step S1017, Step S1018 and Step S1019 can be referred for adjusting the common voltage first and then, compensating the at least one portion of the pixel voltages of the at least two different display areas in the liquid crystal panel.

Specifically, the reason for first adjusting the common voltage is that the whole liquid crystal panel shares a common voltage and a change in the common voltage causes all pixel voltages to change. If the pixel voltage is compensated first and then, the common voltage is adjusted, it will lead to the change of the compensated pixel voltage, again to increase the cost of time. Therefore, the common voltage is adjusted first and then, the pixel voltages are compensated. The time cost of determining the common voltage and the pixel voltage can be decreased. Besides, the value of the common voltage is a clear value for a person who is skilled in this art or is within a definite range so that the common voltage is easier to determine.

Optionally, compensating the at least one portion of the pixel voltages of the at least two different display areas in the liquid crystal panel comprises dividing at least one portion of the pixels of the at least two different display areas in the liquid crystal panel into various plurality of display areas for compensation. Then, it is not necessary to adjust the at least one portion of the pixel voltages of the at least two different display areas of the liquid crystal panel as various values one by one. The pixel voltages of the plurality of pixels can be adjusted to be substantially the same at one time to improve the efficiency.

Step S102, outputting the common voltage and the pixel voltages to compensate the gray scale voltage.

Figure 5:
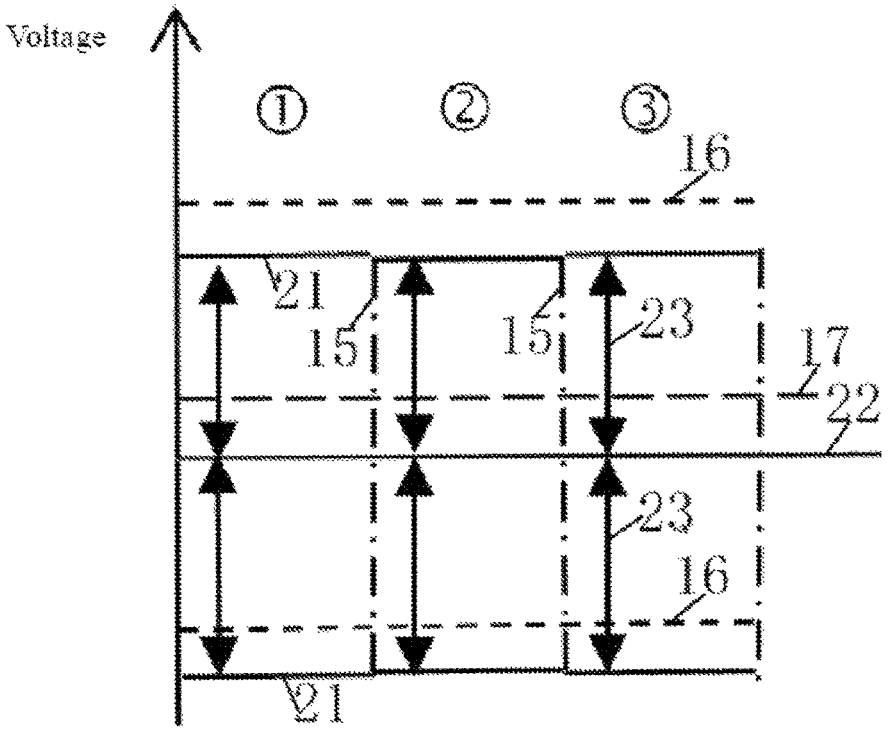
FIG. 5 is a result diagram of a gray scale voltage compensated in a gray scale compensation method of a liquid crystal panel provided by the first embodiment of the present invention.

Please refer to FIG. 5. FIG. 5 shows a result of a gray scale voltage compensated in a gray scale compensation method of a liquid crystal panel provided by the first embodiment of the present invention. The horizontal gray dotted line 17 in FIG. 5 represents the original common voltage in FIG. 3 (in order to compare the observation and to describe easily, it is in the form of a dotted line). The horizontal gray solid line 22 represents the determined common voltage. The vertical black solid lines with double arrows 23 represent the determined pixel voltages. The horizontal black solid lines 21 in the display areas ①, ② and ③ represent the gray scale voltages due to the influence of the common voltage and the pixel voltage. The reset symbols have the same meanings as those in FIG. 4 and will not be described here. As shown in FIG. 5, the pixel voltages are symmetrical about the common voltage. Thus, the human eye can not feel the flicker phenomenon of liquid crystal panel and the display performance of the liquid crystal panel meets the standards.

In the gray scale voltage compensation method of the liquid crystal panel provided by this embodiment, the liquid crystal panel with one common voltage is utilized for saving the cost. By adjusting the common voltage and/or compensating the at least one portion of the pixel voltages of the at least two different display areas in the liquid crystal panel, the common voltage and the pixel voltages are determined so that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal. Thus, the afterimage of the whole liquid crystal panel is decreased to a minimum. The panel display performance is greatly improved while the cost of the liquid crystal panel is saved.

The second embodiment of the present invention provides a circuit for a liquid crystal panel. The liquid crystal panel comprises: a plurality of gate lines parallel to one another, a plurality of data lines parallel to one another and intersected with the gate lines in a perpendicular and insulated manner, a plurality of thin film transistors located at intersections of the gate lines and the data lines, a plurality of pixel electrodes and a common electrode, the pixel electrodes are coupled to the data lines via the thin film transistors and arranged opposite to the common electrode; the circuit for the liquid crystal panel comprises a driving circuit and a control circuit; the driving circuit drives the liquid crystal panel; the control circuit adjusts a common voltage and/or compensates at least one portion of pixel voltages of at least two different display areas in the liquid crystal panel via the driving circuit to ultimately determine the common voltage and the pixel voltages, the pixel voltage is an alternating inversion voltage of positive and negative polarities such that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal; the driving circuit also outputs the common voltage and the pixel voltages which are ultimately determined.

Figure 6:
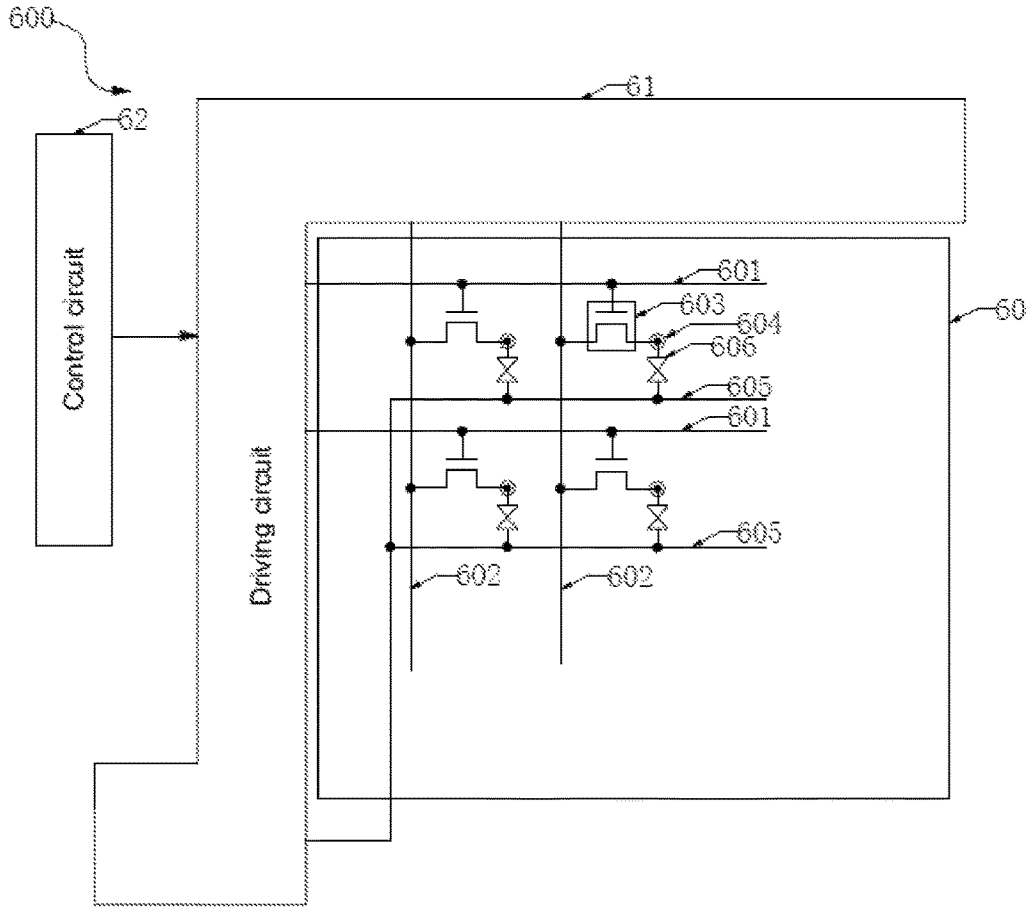
FIG. 6 is an equivalent diagram of a circuit for a liquid crystal panel provided by the second embodiment of the present invention.

Please refer to FIG. 6. FIG. 6 shows an equivalent diagram of a circuit 600 for a liquid crystal panel provided by the second embodiment of the present invention. As shown in FIG. 6, a circuit 600 for a liquid crystal panel comprises a liquid crystal panel 600, a driving circuit 61 and a control circuit 60. The liquid crystal panel 60 comprises: a plurality of gate lines 601 parallel to one another, a plurality of data lines 602 parallel to one another and intersected with the gate lines 601 in a perpendicular and insulated manner, a plurality of thin film transistors 603 located at intersections of the gate lines 601 and the data lines 602, a plurality of pixel electrodes 604 and a common electrode 605, the pixel electrodes 604 are coupled to the data lines 602 via the thin film transistors 603 and arranged opposite to the common electrode 605. The driving circuit 61 drives the liquid crystal panel 60. The control circuit 62 adjusts a common voltage and/or compensates at least one portion of pixel voltages of at least two different display areas in the liquid crystal panel 60 via the driving circuit 61 to ultimately determine the common voltage and the pixel voltages, the pixel voltage is an alternating inversion voltage of positive and negative polarities such that the pixel voltages of the positive and negative polarities of all the pixels of the at least two different display areas in the liquid crystal panel 60 are symmetrical with respect to the common voltage and maximum pixel voltages of the positive polarity of all the pixels of the at least two different display areas are equal. The driving circuit 61 also outputs the common voltage and the pixel voltages which are ultimately determined.

Optionally, the circuit for the liquid crystal panel can further comprise a storage capacitance, which can charge the parallel plates formed by the pixel electrodes and the common electrode after the thin film transistors of the row of the liquid crystal panel are off. Thus, the voltage of the parallel plates formed by the pixel electrodes and the common electrode can be maintained for the next charging. In sum, it can be used to ensure that the same frame display is complete and clear.

Optionally, the driving circuit comprises a gate line driving circuit, a data line driving circuit and a common electrode driving circuit, the gate line driving circuit is coupled to the gate lines, the data line driving circuit is coupled to the data lines, the gate line driving circuit and the data line driving circuit act on the pixel electrodes, the common electrode driving circuit is coupled to the common electrode and the common electrode driving circuit acts on the common electrode; the circuit for the liquid crystal panel further comprises an image collecting and processing circuit; the control circuit comprises a first control circuit and the first control circuit is electrically coupled to the image collecting and processing circuit; the first control circuit constantly adjusts a value of the common voltage and sets the pixel voltage as one of a positive polarity voltage and a negative polarity voltage corresponding to the value of the common voltage; the image collecting and processing circuit collects two images including the at least two different display areas of the liquid crystal panel, which are respectively marked as a first positive image and a first negative image after the first control circuit adjusts the value of the common voltage each time, the first positive image corresponds to the pixel voltage of the positive polarity voltage and the first negative image corresponds to the pixel voltage of the negative polarity voltage; the image collecting and processing circuit further calculates a first similarity of a luminance value of the first positive image and a luminance value of the first negative image; the image collecting and processing circuit further compares a calculation result of the first similarity with a predetermined threshold range; the calculation result of the first similarity conforms to the predetermined threshold range and the first control circuit stops operation;

and/or the control circuit comprises a second control circuit and the second control circuit is electrically coupled to the image collecting and processing circuit; the second control circuit constantly compensates a value of the pixel voltage and the pixel voltage is the positive polarity voltage and the negative polarity voltage, each compensated once; the image collecting and processing circuit collects two images including the at least two different display areas of the liquid crystal panel, which are respectively marked as a second positive image and a second negative image after the second control circuit each compensates the value of the pixel voltage once, the second positive image corresponds to the pixel voltage of the positive polarity voltage and the second negative image corresponds to the pixel voltage of the negative polarity voltage; the image collecting and processing circuit further calculates a second similarity of a luminance value of the second positive image and a luminance value of the second negative image; the image collecting and processing circuit further compares a calculation result of the second similarity with the predetermined threshold range; the calculation result of the second similarity conforms to the predetermined threshold range and the second control circuit stops operation.

Figure 7:
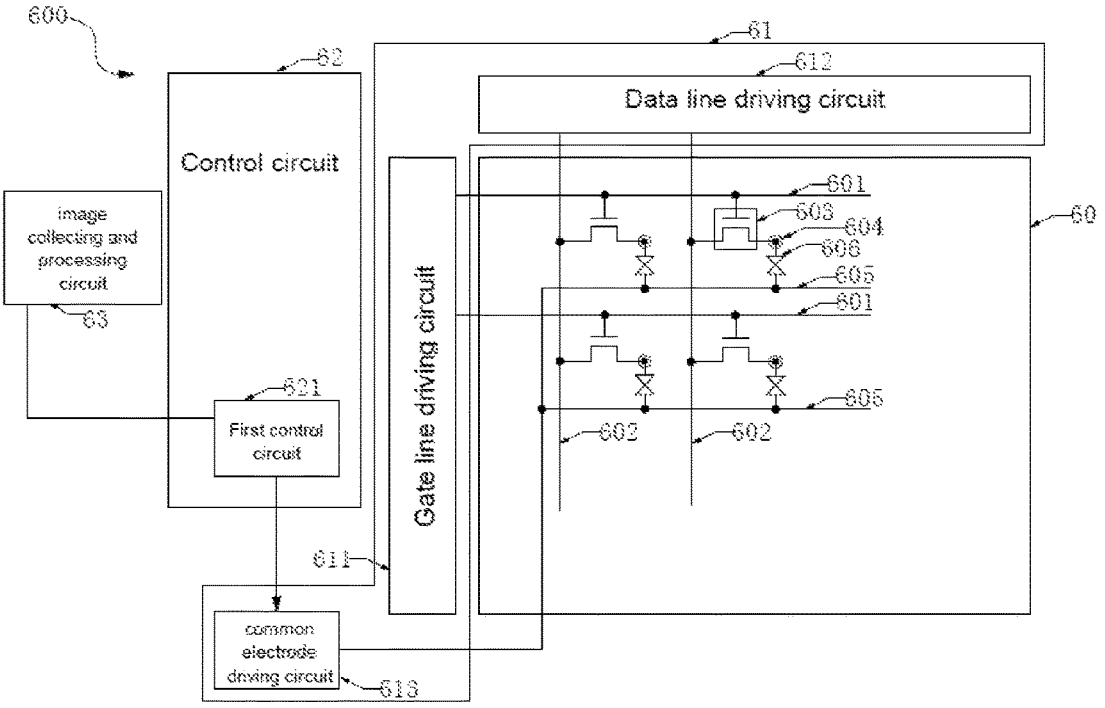
FIG. 7 is an equivalent diagram of a circuit for a liquid crystal panel provided by the second embodiment of the present invention.

Please refer to FIG. 7. FIG. 7 shows an equivalent diagram of a circuit 600 for a liquid crystal panel provided by the second embodiment of the present invention. As shown in FIG. 7, the driving circuit 61 comprises a gate line driving circuit 611, a data line driving circuit 612 and a common electrode driving circuit 613, the gate line driving circuit 611 is coupled to the gate lines 601, the data line driving circuit 612 is coupled to the data lines 602, the gate line driving circuit 611 and the data line driving circuit 612 act on the pixel electrodes 604, the common electrode driving circuit 613 is coupled to the common electrode 605 and the common electrode driving circuit 613 acts on the common electrode 605; the circuit 600 for the liquid crystal panel 60 further comprises an image collecting and processing circuit 63; the control circuit 62 comprises a first control circuit 621 and the first control circuit 621 is electrically coupled to the image collecting and processing circuit 63; the first control circuit 621 constantly adjusts a value of the common voltage and sets the pixel voltage as one of a positive polarity voltage and a negative polarity voltage corresponding to the value of the common voltage; the image collecting and processing circuit 63 collects two images including the at least two different display areas of the liquid crystal panel, which are respectively marked as a first positive image and a first negative image after the first control circuit 621 adjusts the value of the common voltage each time, the first positive image corresponds to the pixel voltage of the positive polarity voltage and the first negative image corresponds to the pixel voltage of the negative polarity voltage; the image collecting and processing circuit 63 further calculates a first similarity of a luminance value of the first positive image and a luminance value of the first negative image; the image collecting and processing circuit 63 further compares a calculation result of the first similarity with a predetermined threshold range; the calculation result of the first similarity conforms to the predetermined threshold range and the first control circuit 621 stops operation.

Figure 8:
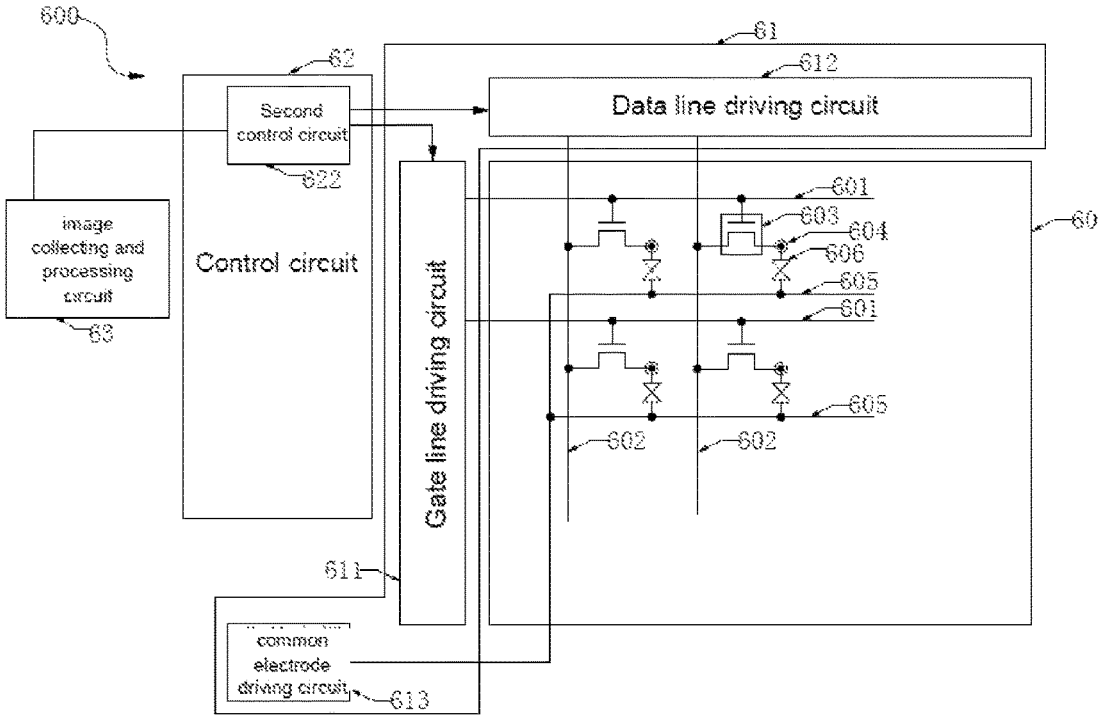
FIG. 8 is an equivalent diagram of a circuit for a liquid crystal panel provided by the second embodiment of the present invention.

FIG. 7 is an equivalent diagram of a circuit for a liquid crystal panel provided by the second embodiment of the present invention;

Please refer to FIG. 8. FIG. 8 is an equivalent diagram of a circuit for a liquid crystal panel provided by the second embodiment of the present invention. As shown in FIG. 8, the control circuit 62 comprises a second control circuit 622 and the second control circuit 622 is electrically coupled to the image collecting and processing circuit 63; the second control circuit 622 constantly compensates a value of the pixel voltage and the pixel voltage is the positive polarity voltage and the negative polarity voltage, each compensated once; the image collecting and processing circuit 63 collects two images including the at least two different display areas of the liquid crystal panel 60, which are respectively marked as a second positive image and a second negative image after the second control circuit 622 each compensates the value of the pixel voltage once, the second positive image corresponds to the pixel voltage of the positive polarity voltage and the second negative image corresponds to the pixel voltage of the negative polarity voltage; the image collecting and processing circuit 63 further calculates a second similarity of a luminance value of the second positive image and a luminance value of the second negative image; the image collecting and processing circuit 63 further compares a calculation result of the second similarity with the predetermined threshold range; the calculation result of the second similarity conforms to the predetermined threshold range and the second control circuit 622 stops operation.

Specifically, the elements which are not described in FIG. 8 and the reference numerals thereof may be the same as those in FIG. 6 and in FIG. 7.

Figure 9:
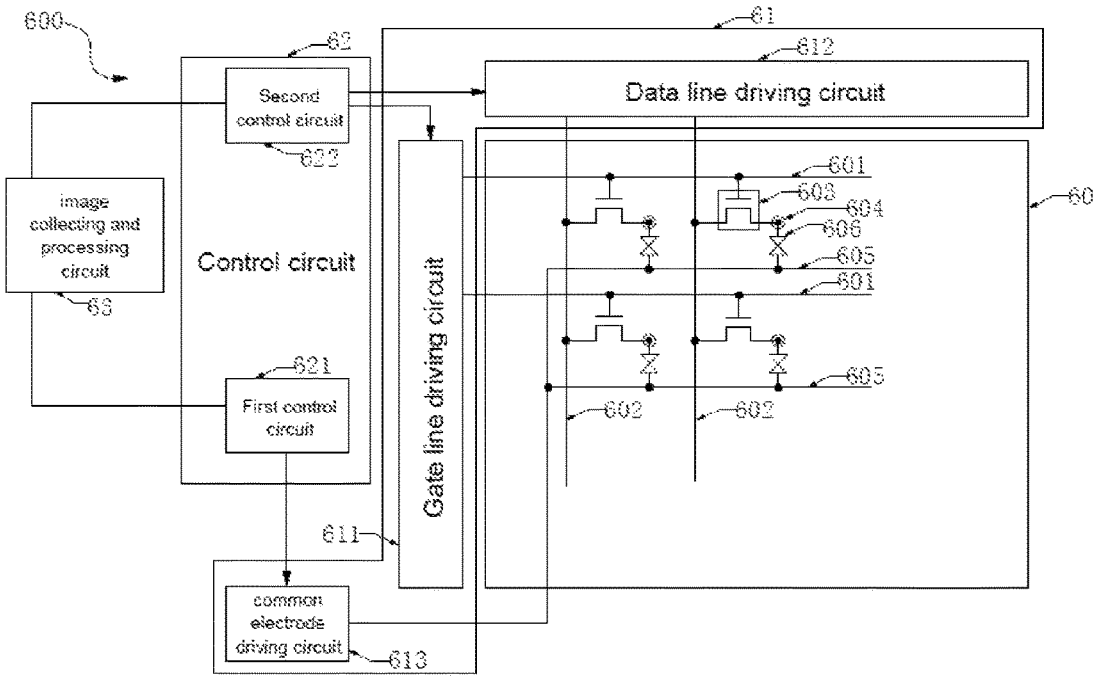
FIG. 9 is an equivalent diagram of a circuit for a liquid crystal panel provided by the second embodiment of the present invention.

Please refer to FIG. 9. FIG. 9 is an equivalent diagram of a circuit for a liquid crystal panel provided by the second embodiment of the present invention. FIG. 9 comprises the first control circuit 621 in FIG. 7 and the second control circuit 622 in FIG. 8. The description of FIG. 9 can be the same as the descriptions of the corresponding part in FIG. 7 and the corresponding part in FIG. 8. The repeated description is omitted here.

Optionally, calculating the first similarity of the luminance value of the first positive image and the luminance value of the first negative image comprises: calculating an expectation and a standard deviation of absolute values of differences of the luminance values of the pixels corresponding to the first positive image and the first negative image;

and/or calculating the second similarity of the luminance value of the second positive image and the luminance value of the second negative image comprises calculating an expectation and a standard deviation of absolute values of differences of the luminance values of the pixels corresponding to the second positive image and the second negative image.

Alternatively, the calculation of the first similarity and the second similarity may also employ other methods in mathematical statistics, such as the Pearson correlation coefficient, the Chebyshev distance or the cosine similarity.

The explanation of the corresponding nouns and sentence meanings in the foregoing method embodiments can be used in the present embodiment and will not be described here, again.

The third embodiment of the present invention provides a liquid crystal panel, comprising a circuit for the liquid crystal panel, wherein the liquid crystal panel comprises: a plurality of gate lines parallel to one another, a plurality of data lines parallel to one another and intersected with the gate lines in a perpendicular and insulated manner, a plurality of thin film transistors located at intersections of the gate lines and the data lines, a plurality of pixel electrodes and a common electrode, the pixel electrodes are coupled to the data lines via the thin film transistors and arranged opposite to the common electrode;

the circuit for the liquid crystal panel comprises a driving circuit and a control circuit;

the driving circuit drives the liquid crystal panel;

the control circuit adjusts a common voltage and/or compensates at least one portion of pixel voltages of at least two different display areas in the liquid crystal panel via the driving circuit to ultimately determine the common voltage and the pixel voltages, the pixel voltage is an alternating inversion voltage of positive and negative polarities such that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal;

the driving circuit also outputs the common voltage and the pixel voltages which are ultimately determined.

Figure 10:
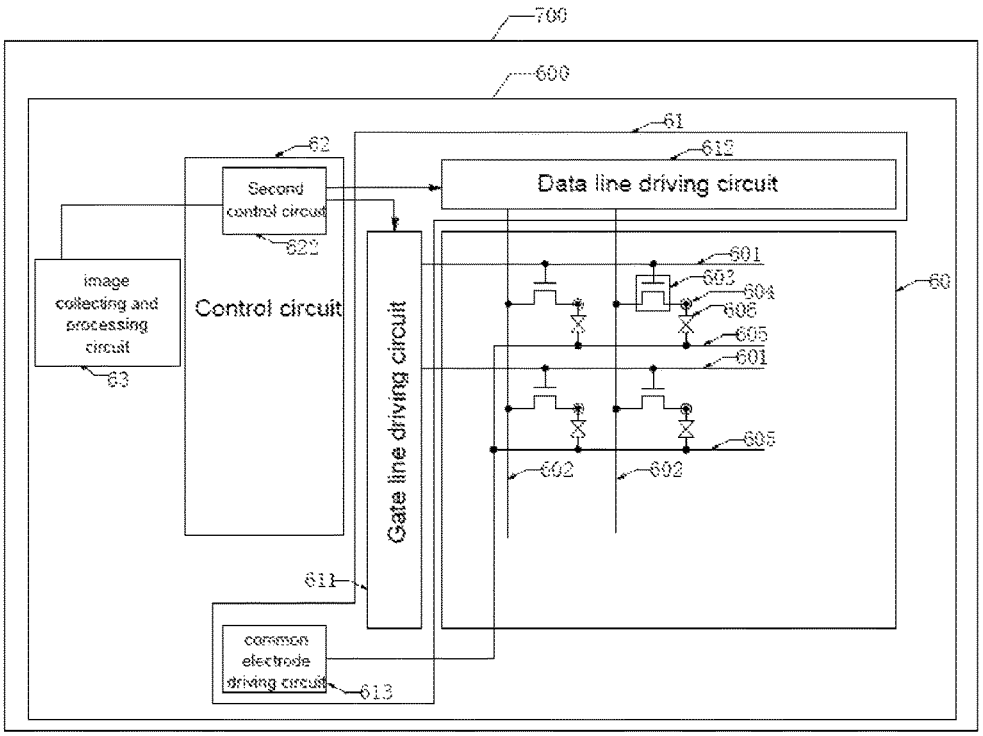
FIG. 10 is a liquid crystal panel provided by the third embodiment of the present invention.

Please refer to FIG. 10. FIG. 10 is a liquid crystal panel provided by the third embodiment of the present invention. As shown in FIG. 10, the liquid crystal panel 700 comprises the circuit 600 for the liquid crystal panel in the second embodiment of the present invention. FIG. 10 merely shows the illustrative description.

Optionally, the liquid crystal used in the liquid crystal panel can be positive liquid crystal or negative liquid crystal.

Specifically, the negative liquid crystal has a high transmittance with respect to the positive liquid crystal so that the liquid crystal panel has a better picture quality and a lower color deviation. However, due to the properties of the negative liquid crystal itself, the afterimage is more serious than the positive liquid crystal, especially the afterimage in the vicinity of the module adhesion. The liquid crystal panel including any circuit in the second embodiment of the present invention uses the negative liquid crystal and utilizes the high transmittance of the negative liquid crystal such that the liquid crystal panel possesses the better picture quality and the lower color deviation. Meanwhile, the circuit in the second embodiment can be utilized to reduce the afterimage due to the negative liquid crystal to be minimal. Therefore, such a liquid crystal panel using the negative liquid crystal can greatly improve the display performance.

The explanation of the corresponding nouns and sentence meanings in the foregoing method embodiments can be used in the present embodiment, such as the first control circuit, the second control circuit, and the image collecting and processing circuit and will not be described here, again.

The fourth embodiment of the present invention provides an apparatus having a storage function on which a command is stored and the instruction is executed by the processor to implement the steps of any one of the methods described in the first embodiment.

Optionally, a device with a storage function is a carrier for storing data, such as a floppy disk, an optical disk, a DVD, a mechanical hard disk, a solid state hard disk, a flash memory, a USB flash drive, a CF card, an SD card, an MMC card, a SM card, a Memory Stick, an XD card, a gene hard disk, and a storage medium used in various terminals, servers and chips and is not specifically limited here.

Optionally, the device with the storage function can be a DNA hard disk. The key of using DNA storage instruction data is DNA base. The DNA double helix structure has four different molecular groups, namely nucleobases, which respectively are adenine deoxynucleotides (dAMP, deoxyadenosine, referred to as A base), thymidine deoxynucleotides (dTMP, deoxythymidine, referred to as T base), cytosine deoxynucleotides (dCMP, deoxycytidine, Referred to as C base), guanine deoxynucleotides (dGMP, deoxyguanosine, referred to as G base) In a particular order and each molecule group can store instructions.

The DNA storage instruction may be a custom code translated from the binary number in the hard disk information and then a standard DNA synthesis machine is used to produce a corresponding base sequence. The base sequence is a plurality of repeating fragments, of which each fragment carrying some of index details, determining the respective positions in the whole sequence and storing the instructions in the four bases of each fragment.

The data stored within a DNA hard disk may last for a thousand years and the instructions will not be lost even if some fragments are damaged. Besides, one of the significant advantages of DNA as the digital storage medium is its large capacity. DNA molecules are an incredibly dense storage medium. For instance, 1 gram of DNA can store about 2 Petabytes (2 PB), which is equivalent to about 3 million compact discs. As regarding the reading, the DNA storage does not involve compatibility issues and the information reading success rate is extremely high.

The explanation of the corresponding nouns and sentence meanings in the foregoing first, second and third embodiments can be used in the present embodiment and will not be described here, again.

Specifically, as concerning a circuit for a liquid crystal panel, a liquid crystal panel, a device having storage function and the overall contents of the respective embodiments, since the method embodiments of the present invention are based on the same concept, the technical effect is the same as that of the method embodiments of the present invention. The specific content can refer to the description of the method embodiments of the present invention and will not be described here, again.

Specifically, all words, such as "first" and "second", the first positive image and the second negative image are intended to be merely illustrative and intended for convenience in all aspects of the present invention and are not meant that there must be a first positive image and a second negative image corresponding thereto in the specific implementation of the invention.

The foregoing detailed description of the principles and embodiments of the present invention is merely in more details with reference to specific embodiments thereof. The specific embodiments of the invention are not to be construed as limited to the description but only for the purpose of understanding the method and major idea of the invention; meanwhile, it will be apparent to those skilled in the art, without departing from the teachings of the present invention, it should be considered as falling within the protected scope of the present invention with equivalent structure or equivalent process transformation using the present specification and the accompanying drawings, or directly or indirectly In other related technical fields.

What is claimed is:

1. A circuit for a liquid crystal panel, wherein the liquid crystal panel comprises: a plurality of gate lines parallel to one another, a plurality of data lines parallel to one another and intersected with the gate lines in a perpendicular and insulated manner, a plurality of thin film transistors located at intersections of the gate lines and the data lines, a plurality of pixel electrodes and a common electrode, the pixel electrodes are coupled to the data lines via the thin film transistors and arranged opposite to the common electrode;

the circuit for the liquid crystal panel comprises a driving circuit and a control circuit;

the driving circuit drives the liquid crystal panel;

the control circuit adjusts a common voltage and/or compensates at least one portion of pixel voltages of at least two different display areas in the liquid crystal panel via the driving circuit to ultimately determine the common voltage and the pixel voltages, the pixel voltage is an alternating inversion voltage of positive and negative polarities such that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal;

the driving circuit also outputs the common voltage and the pixel voltages which are ultimately determine;

the driving circuit comprises a gate line driving circuit, a data line driving circuit and a common electrode driving circuit, the gate line driving circuit is coupled to the gate lines, the data line driving circuit is coupled to the data lines, the gate line driving circuit and the data line driving circuit act on the pixel electrodes, the common electrode driving circuit is coupled to the common electrode and the common electrode driving circuit acts on the common electrode;

the circuit for the liquid crystal panel further comprises an image collecting and processing circuit;

the control circuit comprises a first control circuit and the first control circuit is electrically coupled to the image collecting and processing circuit;

the first control circuit constantly adjusts a value of the common voltage and sets the pixel voltage as one of a positive polarity voltage and a negative polarity voltage corresponding to the value of the common voltage;

the image collecting and processing circuit collects two images including the at least two different display areas of the liquid crystal panel, which are respectively marked as a first positive image and a first negative image after the first control circuit adjusts the value of the common voltage each time, the first positive image corresponds to the pixel voltage of the positive polarity voltage and the first negative image corresponds to the pixel voltage of the negative polarity voltage;

the image collecting and processing circuit further calculates a first similarity of a luminance value of the first positive image and a luminance value of the first negative image;

the image collecting and processing circuit further compares a calculation result of the first similarity with a predetermined threshold range;

the calculation result of the first similarity conforms to the predetermined threshold range and the first control circuit stops operation.

2. The circuit for the liquid crystal panel according to claim 1, wherein the control circuit comprises a second control circuit and the second control circuit is electrically coupled to the image collecting and processing circuit;

the second control circuit constantly compensates a value of the pixel voltage and the pixel voltage is the positive polarity voltage and the negative polarity voltage, each compensated once;

the image collecting and processing circuit collects two images including the at least two different display areas of the liquid crystal panel, which are respectively marked as a second positive image and a second negative image after the second control circuit each compensates the value of the pixel voltage once, the second positive image corresponds to the pixel voltage of the positive polarity voltage and the second negative image corresponds to the pixel voltage of the negative polarity voltage;

the image collecting and processing circuit further calculates a second similarity of a luminance value of the second positive image and a luminance value of the second negative image;

the image collecting and processing circuit further compares a calculation result of the second similarity with the predetermined threshold range;

the calculation result of the second similarity conforms to the predetermined threshold range and the second control circuit stops operation.

3. The circuit for the liquid crystal panel according to claim 2, wherein calculating the second similarity of the luminance value of the second positive image and the luminance value of the second negative image comprises: calculating an expectation and a standard deviation of absolute values of differences of the luminance values of the pixels corresponding to the second positive image and the second negative image.

4. The circuit for the liquid crystal panel according to claim 2, wherein calculating the first similarity of the luminance value of the first positive image and the luminance value of the first negative image comprises: calculating an expectation and a standard deviation of absolute values of differences of the luminance values of the pixels corresponding to the first positive image and the first negative image;

and calculating the second similarity of the luminance value of the second positive image and the luminance value of the second negative image comprises: calculating an expectation and a standard deviation of absolute values of differences of the luminance values of the pixels corresponding to the second positive image and the second negative image.

5. The circuit for the liquid crystal panel according to claim 1, wherein calculating the first similarity of the luminance value of the first positive image and the luminance value of the first negative image comprises: calculating an expectation and a standard deviation of absolute values of differences of the luminance values of the pixels corresponding to the first positive image and the first negative image.

6. A gray scale voltage compensation method of a liquid crystal panel, comprising steps of:

determining a common voltage and pixel voltages, wherein the pixel voltage is an alternating inversion voltage of positive and negative polarities such that the pixel voltages of the positive and negative polarities of all pixels of at least two different display areas in the liquid crystal panel are symmetrical with respect to the common voltage and maximum pixel voltages of the positive polarity of all the pixels of the at least two different display areas are equal, wherein the common voltage is adjusted and/or at least one portion of the pixel voltages of the at least two different display areas in the liquid crystal panel are compensated;

outputting the common voltage and the pixel voltages;

a step of adjusting the common voltage comprises steps of:

constantly adjusting a value of the common voltage and outputting the same and setting the pixel voltage as one of a positive polarity voltage and a negative polarity voltage corresponding to the value of the common voltage;

collecting two images including the at least two different display areas of the liquid crystal panel, which are respectively marked as a first positive image and a first negative image after adjusting the value of the common voltage and outputting the same each time, wherein the first positive image corresponds to the pixel voltage of the positive polarity voltage and the first negative image corresponds to the pixel voltage of the negative polarity voltage;

calculating a first similarity of a luminance value of the first positive image and a luminance value of the first negative image;

comparing a calculation result of the first similarity with a predetermined threshold range;

stopping adjusting the value of the common voltage until the calculation result of the first similarity conforms to the predetermined threshold range.

7. The gray scale voltage compensation method of the liquid crystal panel according to claim 6, wherein a step of compensating the at least one portion of the pixel voltages of the at least two different display areas in the liquid crystal panel comprises steps of:

constantly compensating a value of the pixel voltage and outputting the same, wherein the pixel voltage is the positive polarity voltage and the negative polarity voltage, each compensated once;

collecting two images including the at least two different display areas of the liquid crystal panel, which are respectively marked as a second positive image and a second negative image after each compensating the value of the pixel voltage once and outputting the same, wherein the second positive image corresponds to the pixel voltage of the positive polarity voltage and the second negative image corresponds to the pixel voltage of the negative polarity voltage;

calculating a second similarity of a luminance value of the second positive image and a luminance value of the second negative image;

comparing a calculation result of the second similarity with the predetermined threshold range;

stopping compensating the value of the pixel voltage until the calculation result of the second similarity conforms to the predetermined threshold range.

8. The gray scale voltage compensation method of the liquid crystal panel according to claim 7, wherein a step of calculating the first similarity of the luminance value of the first positive image and the luminance value of the first negative image comprises: calculating an expectation and a standard deviation of absolute values of differences of the luminance values of the pixels corresponding to the first positive image and the first negative image;

and/or calculating the second similarity of the luminance value of the second positive image and the luminance value of the second negative image comprises: calculating an expectation and a standard deviation of absolute values of differences of the luminance values of the pixels corresponding to the second positive image and the second negative image.

9. The gray scale voltage compensation method of the liquid crystal panel according to claim 6, wherein a step of adjusting the common voltage and a step of compensating the at least one portion of the pixel voltages of the at least two different display areas in the liquid crystal panel comprise: adjusting the common voltage first and then, compensating the at least one portion of the pixel voltages of the at least two different display areas in the liquid crystal panel.

10. The gray scale voltage compensation method of the liquid crystal panel according to claim 6, wherein a step of calculating the first similarity of the luminance value of the first positive image and the luminance value of the first negative image comprises: calculating an expectation and a standard deviation of absolute values of differences of the luminance values of the pixels corresponding to the first positive image and the first negative image.

11. A liquid crystal panel, comprising a circuit for the liquid crystal panel, wherein the liquid crystal panel comprises: a plurality of gate lines parallel to one another, a plurality of data lines parallel to one another and intersected with the gate lines in a perpendicular and insulated manner, a plurality of thin film transistors located at intersections of the gate lines and the data lines, a plurality of pixel electrodes and a common electrode, the pixel electrodes are coupled to the data lines via the thin film transistors and arranged opposite to the common electrode;

the circuit for the liquid crystal panel comprises a driving circuit and a control circuit;

the driving circuit drives the liquid crystal panel;

the control circuit adjusts a common voltage and/or compensates at least one portion of pixel voltages of at least two different display areas in the liquid crystal panel via the driving circuit to ultimately determine the common voltage and the pixel voltages, the pixel voltage is an alternating inversion voltage of positive and negative polarities such that the pixel voltages of the positive and negative polarities of all the pixels of the at least two different display areas in the liquid crystal panel are symmetrical with respect to the common voltage and maximum pixel voltages of the positive polarity of all the pixels of the at least two different display areas are equal;

the driving circuit also outputs the common voltage and the pixel voltages which are ultimately determine;

the driving circuit comprises a gate line driving circuit, a data line driving circuit and a common electrode driving circuit, the gate line driving circuit is coupled to the gate lines, the data line driving circuit is coupled to the data lines, the gate line driving circuit and the data line driving circuit act on the pixel electrodes, the common electrode driving circuit is coupled to the common electrode and the common electrode driving circuit acts on the common electrode;

the circuit for the liquid crystal panel further comprises an image collecting and processing circuit;

the control circuit comprises a first control circuit and the first control circuit is electrically coupled to the image collecting and processing circuit;

the first control circuit constantly adjusts a value of the common voltage and sets the pixel voltage as one of a positive polarity voltage and a negative polarity voltage corresponding to the value of the common voltage;

the image collecting and processing circuit collects two images including the at least two different display areas of the liquid crystal panel, which are respectively marked as a first positive image and a first negative image after the first control circuit adjusts the value of the common voltage each time, the first positive image corresponds to the pixel voltage of the positive polarity voltage and the first negative image corresponds to the pixel voltage of the negative polarity voltage;

the image collecting and processing circuit further calculates a first similarity of a luminance value of the first positive image and a luminance value of the first negative image;

the image collecting and processing circuit further compares a calculation result of the first similarity with a predetermined threshold range;

the calculation result of the first similarity conforms to the predetermined threshold range and the first control circuit stops operation.

12. The liquid crystal panel according to claim 11, wherein the control circuit comprises a second control circuit and the second control circuit is electrically coupled to the image collecting and processing circuit;

the second control circuit constantly compensates a value of the pixel voltage and the pixel voltage is the positive polarity voltage and the negative polarity voltage, each compensated once;

the image collecting and processing circuit collects two images including the at least two different display areas of the liquid crystal panel, which are respectively marked as a second positive image and a second negative image after the second control circuit each compensates the value of the pixel voltage once, the second positive image corresponds to the pixel voltage of the positive polarity voltage and the second negative image corresponds to the pixel voltage of the negative polarity voltage;

the image collecting and processing circuit further calculates a second similarity of a luminance value of the second positive image and a luminance value of the second negative image;

the image collecting and processing circuit further compares a calculation result of the second similarity with the predetermined threshold range;

the calculation result of the second similarity conforms to the predetermined threshold range and the second control circuit stops operation.

13. The liquid crystal panel according to claim 12, wherein calculating the first similarity of the luminance value of the first positive image and the luminance value of the first negative image comprises: calculating an expectation and a standard deviation of absolute values of differences of the luminance values of the pixels corresponding to the first positive image and the first negative image;

and/or calculating the second similarity of the luminance value of the second positive image and the luminance value of the second negative image comprises: calculating an expectation and a standard deviation of absolute values of differences of the luminance values of the pixels corresponding to the second positive image and the second negative image.

14. The liquid crystal panel according to claim 12, wherein liquid crystal used in the liquid crystal panel is negative liquid crystal.

* * * * *